US006219864B1

(12) United States Patent
Ellis et al.

(10) Patent No.: US 6,219,864 B1
(45) Date of Patent: Apr. 24, 2001

(54) MONITORING PATIENT HANDLING EQUIPMENT

(75) Inventors: Jonathan Stewart Ellis, Bradford; Philip Ian Ward, Settle; Alan Jackson, Bradford, all of (GB)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 09/314,364

(22) Filed: May 19, 1999

(30) Foreign Application Priority Data

May 19, 1998 (GB) ..... 9810616

(51) Int. Cl.[7] ..... A61G 1/00
(52) U.S. Cl. ..... 5/600; 5/611
(58) Field of Search ..... 5/600, 11, 611

(56) References Cited

U.S. PATENT DOCUMENTS 3,735,101 5/1973 Stewart .
4,207,770 * 6/1980 Grushow ..... 200/61.39
4,233,844 * 11/1980 Dreisinger et al. ..... 73/379.06
5,799,258 * 8/1998 Fidanza et al. ..... 701/1

FOREIGN PATENT DOCUMENTS 0 022 002 A1 1/1981 (EP) .
2 720 177 A1 11/1995 (FR) .

* cited by examiner

*Primary Examiner*—Michael F. Trettel
*Assistant Examiner*—Robert G. Santos
(74) *Attorney, Agent, or Firm*—Killworth, Gottman, Hagan, Schaeff LLP

(57) ABSTRACT

A trolley 10 can be moved between a raised position and a lowered position. The trolley is usually in the lowered position when it is put into an ambulance. A magnet 252 is secured to one connecting leg of the trolley and a counter 258 is connected to the top frame 16 of the trolley. When the trolley is moved to a lower position the magnet 252 comes in close proximity to the counter 258 and a count is recorded. The recorded count gives an indication of the number of times that the trolley has been raised and lowered.

21 Claims, 11 Drawing Sheets

MONITORING PATIENT HANDLING EQUIPMENT

The present invention relates to patient handling equipment and to a method of monitoring patient handling equipment.

Stretcher trolleys are frequently collapsed into a lower position and then raised again. Collapse normally occurs when the trolley is entering an ambulance and the trolley is normally raised when a patient is being manoeuvred on the trolley. Similarly chairs that are used to transport patients are frequently collapsed to a storage position when not in use.

The raising and lowering of the trolleys subjects the trolleys to metal fatigue. Whilst trolleys are serviced regularly there is no way of making a visual inspection of the fatigue that the metal has suffered. Accordingly, good practice is to replace the trolleys when they are likely to have undergone a certain number of raising and lowering operations.

When trolleys are sold they normally go, in a batch order, to a particular authority. That authority then allocates the stretchers either to inner city front line ambulance services, where the trolleys are subjected to frequent raising and lowering, or to suburban or rural services where frequency of use is far less. Nevertheless, good practice dictates that the trolleys are exchanged when fatigue may have occurred to an extent where replacement is required on the assumption that each trolley is an inner city trolley that has been subject to frequent raising and lowering. Alternatively trolleys are frequently kept in use beyond what is to be an acceptable or safe life span.

Similar points apply to the collapsing and erecting of chairs.

It is an object of the present invention to attempt to overcome at least some of the above described disadvantages.

According to one aspect of the present invention patient handling apparatus includes a support portion movable between a first position and a second position, the arrangement including counting means arranged to provide an indication of the number of the times the support portion has been moved to at least one of the positions.

The counting means may be arranged to provide a count when the support portion is moved to at least one of the positions.

The counting means may be arranged to provide an indication of the number of times the support portion has been moved to the second position.

The counting means may comprise first and second parts that are arranged to move relative to each other when the support portion has moved between the two positions. Relative movement of the first and second parts may be arranged to effect the count. The first part may comprise a magnet and the second part may comprise a counter responsive to the magnet, such as being responsive to movement of the magnet. The first and second parts may be arranged to be spaced from each other when the support portion is being moved between the first and second positions and when the support portion is in the first and second positions and monitoring that indication.

The first and second parts may both be arranged to move. One part may move translationally. Alternatively or additionally at least one and preferably both parts may move pivotally. The parts may both be arranged to be mounted in the top region of a stretcher when that stretcher is in both positions. At least one and preferably both parts may be arranged to be located beneath the support portion.

The first and second parts may be arranged to come within 10 mm of each other in order to activate the counting means.

The counting means may be arranged to record every alternative count.

The apparatus may comprise a chair in which the first position is the erect position and the second position is the storage position.

The apparatus may comprise a stretcher trolley in which case the first position is an upper position and the second position is a lower position.

The trolley arrangement may include a first, upper frame arrangement associated with the support portion and being arranged to move between the upper and lower positions. At least one of the first or second parts of the counting means may be mounted to move when the upper frame arrangement moves between the upper and lower positions.

The trolley arrangement may include a second lower frame arrangement that the upper frame arrangement is arranged to move towards and away from when the upper frame arrangement is being moved away from or towards the raised position.

The upper frame arrangement may be arranged to be supported directly on the lower frame arrangement when the support portion is in the lower position.

The upper frame arrangement and the lower frame arrangement may be connected together by a linkage arranged to control the movement between the upper and lower frame arrangements.

At least part of the counting means may be concealed. At least part of the counting means may be located in part of a frame of the patient handling equipment or mounted on or to a part of a frame of the trolley arrangement. The part of the counting means that is located in part of the frame may be visible through part of the frame. Alternatively or additionally that part may be accessible by removing part of the frame such as a cover on part of the frame.

According to a further aspect of the present invention a method of monitoring patient handling apparatus comprises providing an indication of the number of times a support portion of the apparatus is moved between first and second positions.

The apparatus may comprise a chair in which case the method may comprise monitoring the erecting and collapsing of the chair. Alternatively the apparatus may comprise a stretcher in which case the method may comprise monitoring movement between an upper and a lower position. The trolley arrangement may include wheels that the trolley arrangement is moved on.

The method may comprise periodically monitoring the number of times that the support portion has been moved between the upper and lower positions and causing an event to occur as a result of the number of times that a support portion has been moved to at least one of the positions, that event being, for instance, to provide a service for the apparatus, or to vary the service that is provided, or to recommend replacement of at least part of the apparatus.

The method may comprise viewing a counter when the apparatus is being monitored and the method may comprise viewing the counter through a part of the apparatus or the method may comprise moving a part of the apparatus in order to view the counter.

The method may comprise monitoring alternate counts.

The present invention includes any combination of the herein referred to features or limitations.

The present invention may be carried into practice in various ways but several embodiments will now be described, by way of example, and with reference to the accompanying drawings, in which.

Figure 3:
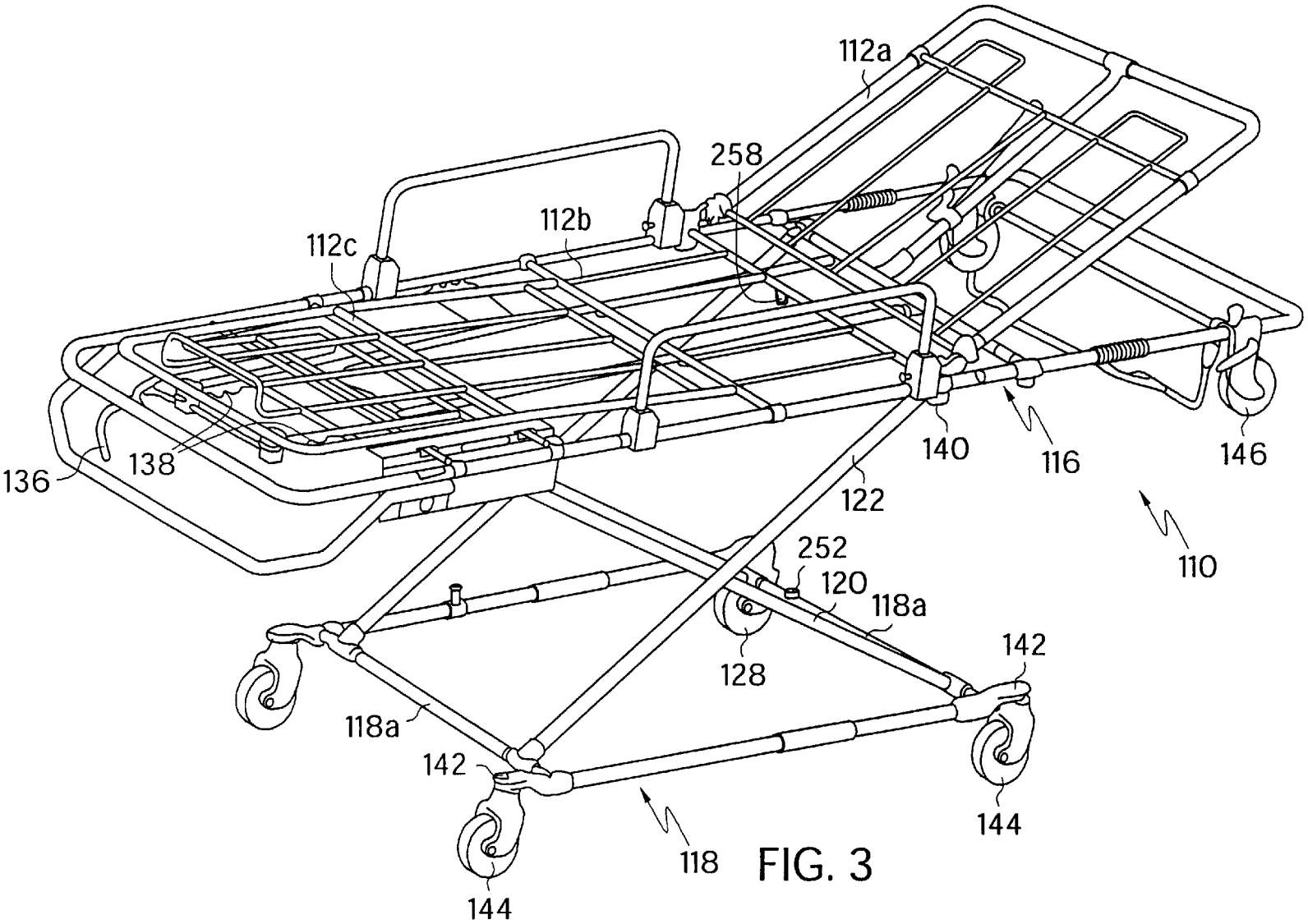
Figure 4:
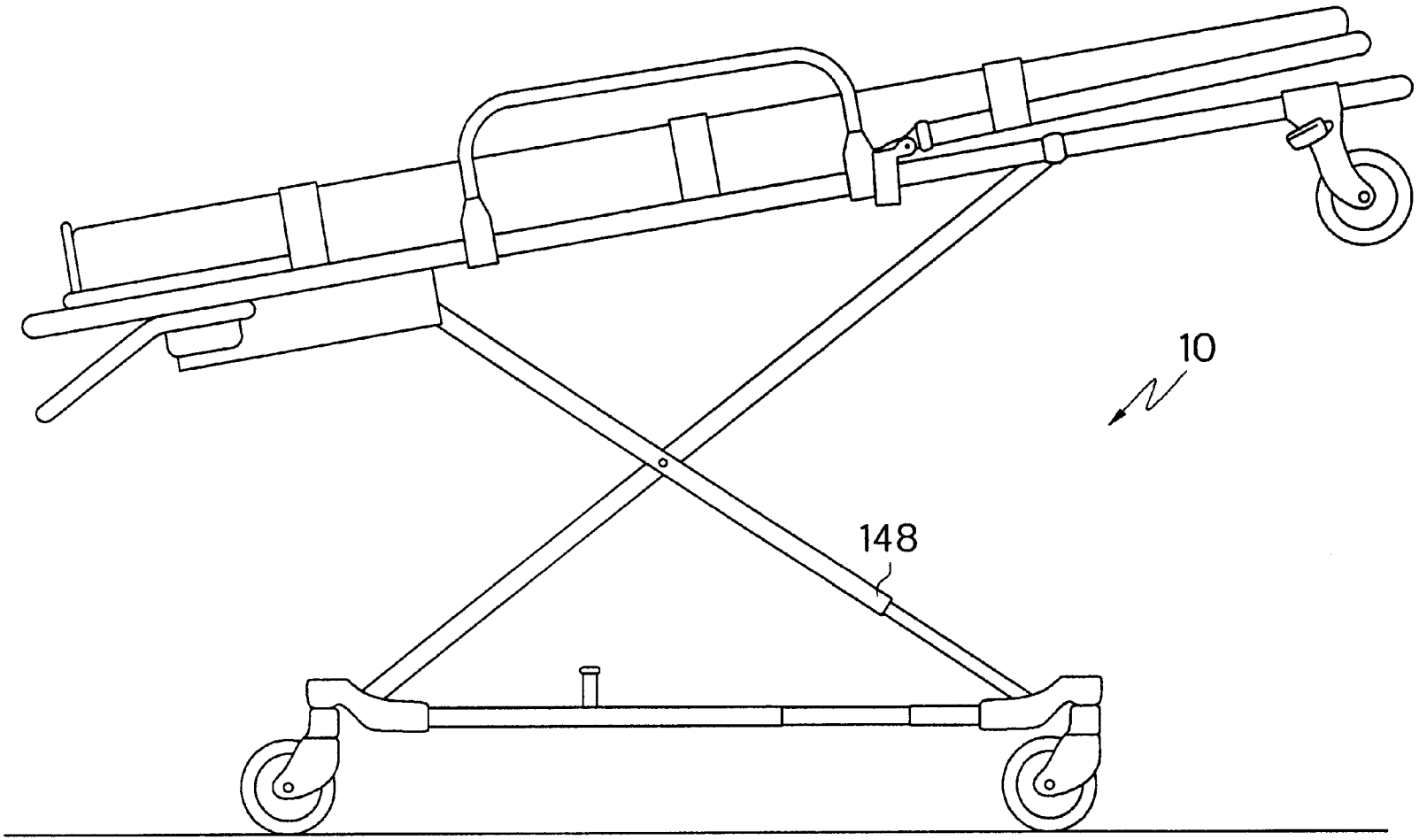
Figure 5:
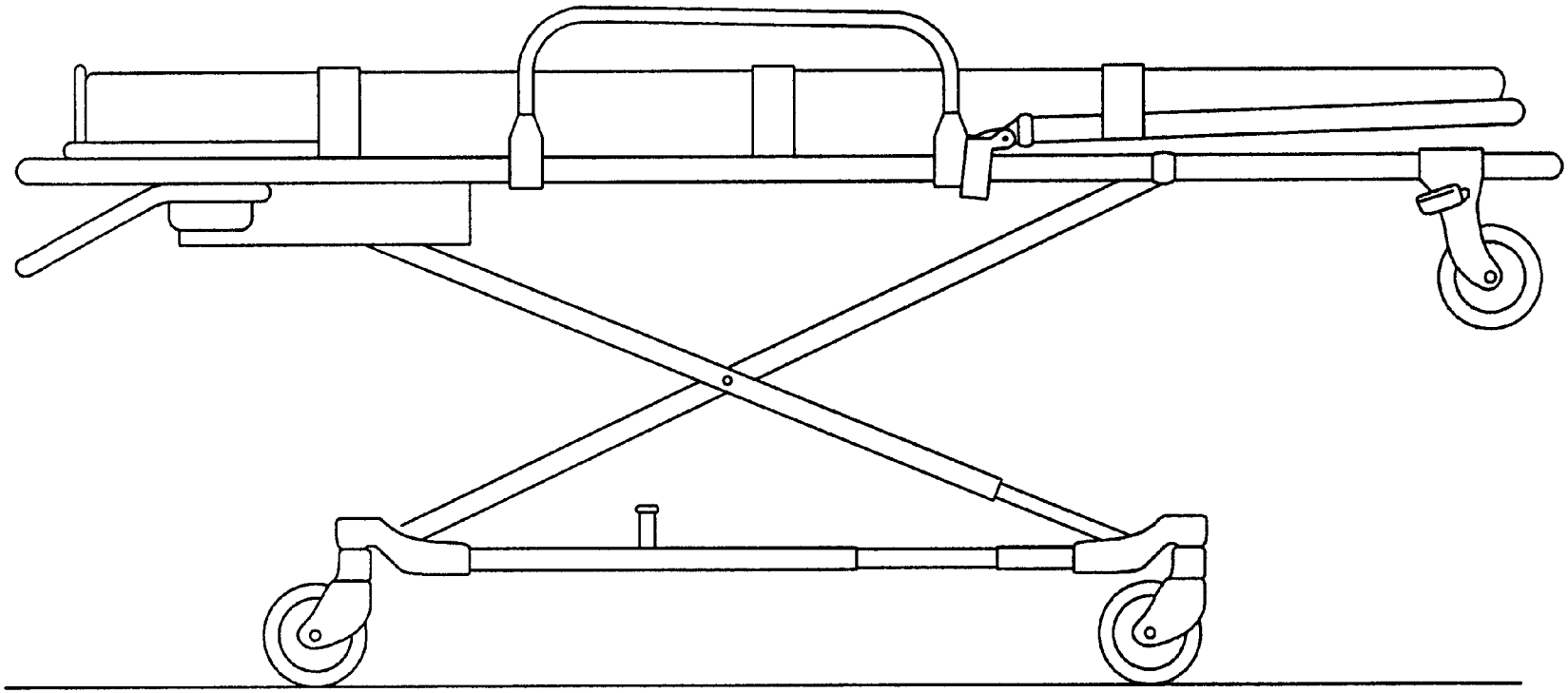
Figure 6:
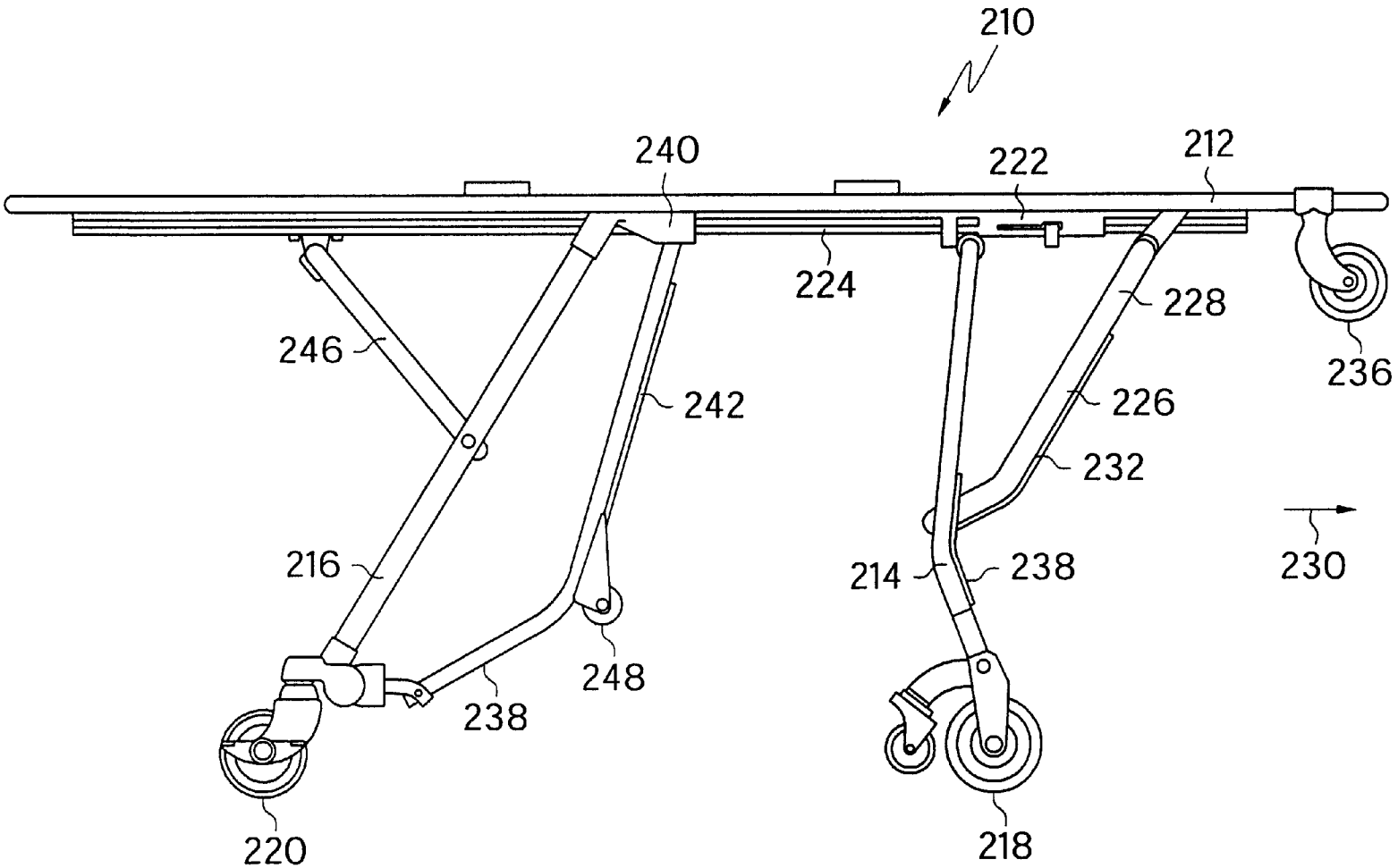
Figure 7:
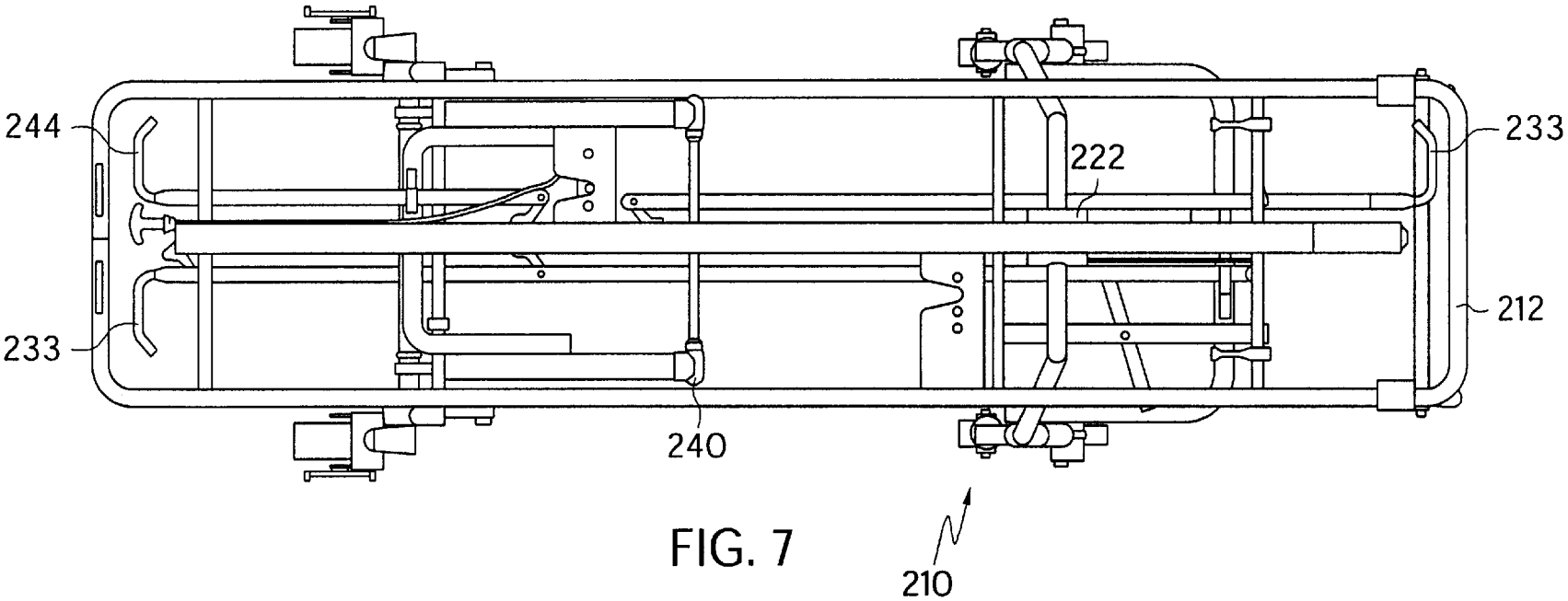
Figure 10:
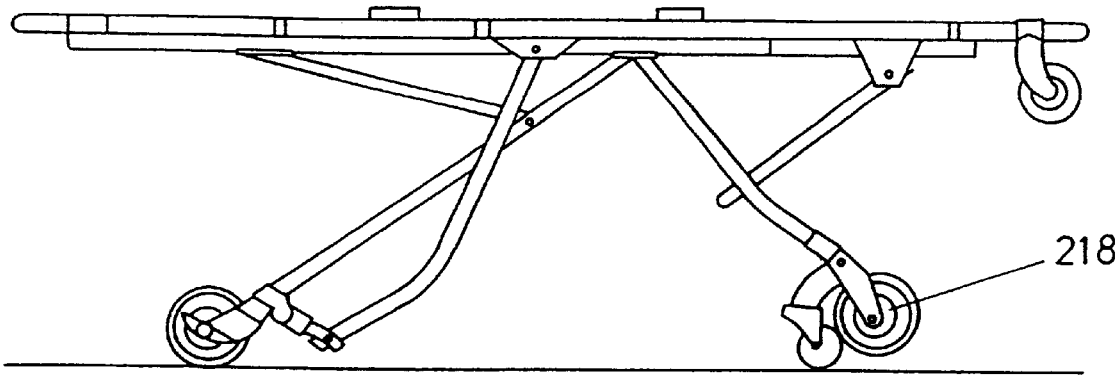
Figure 11:
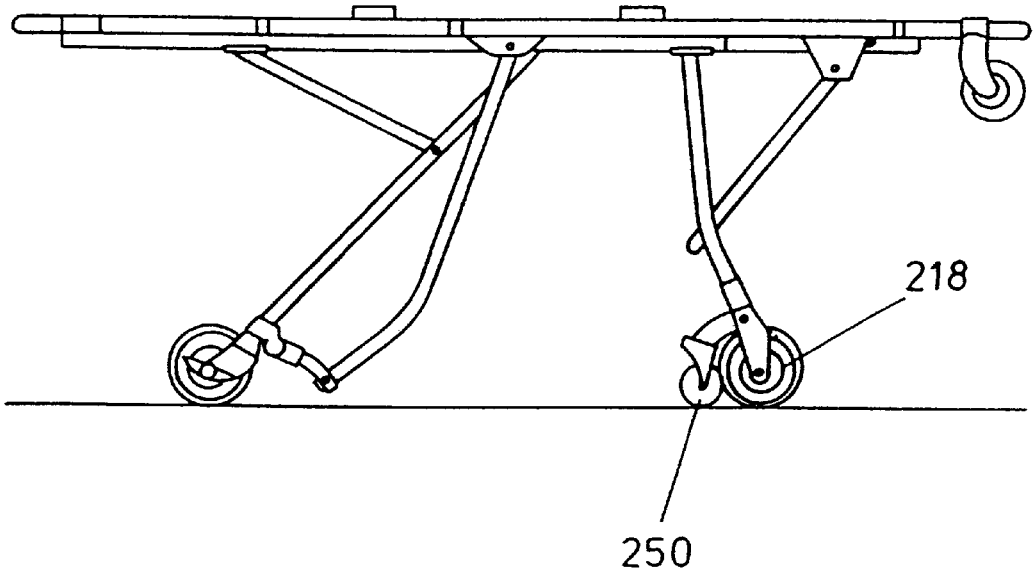
Figure 12:
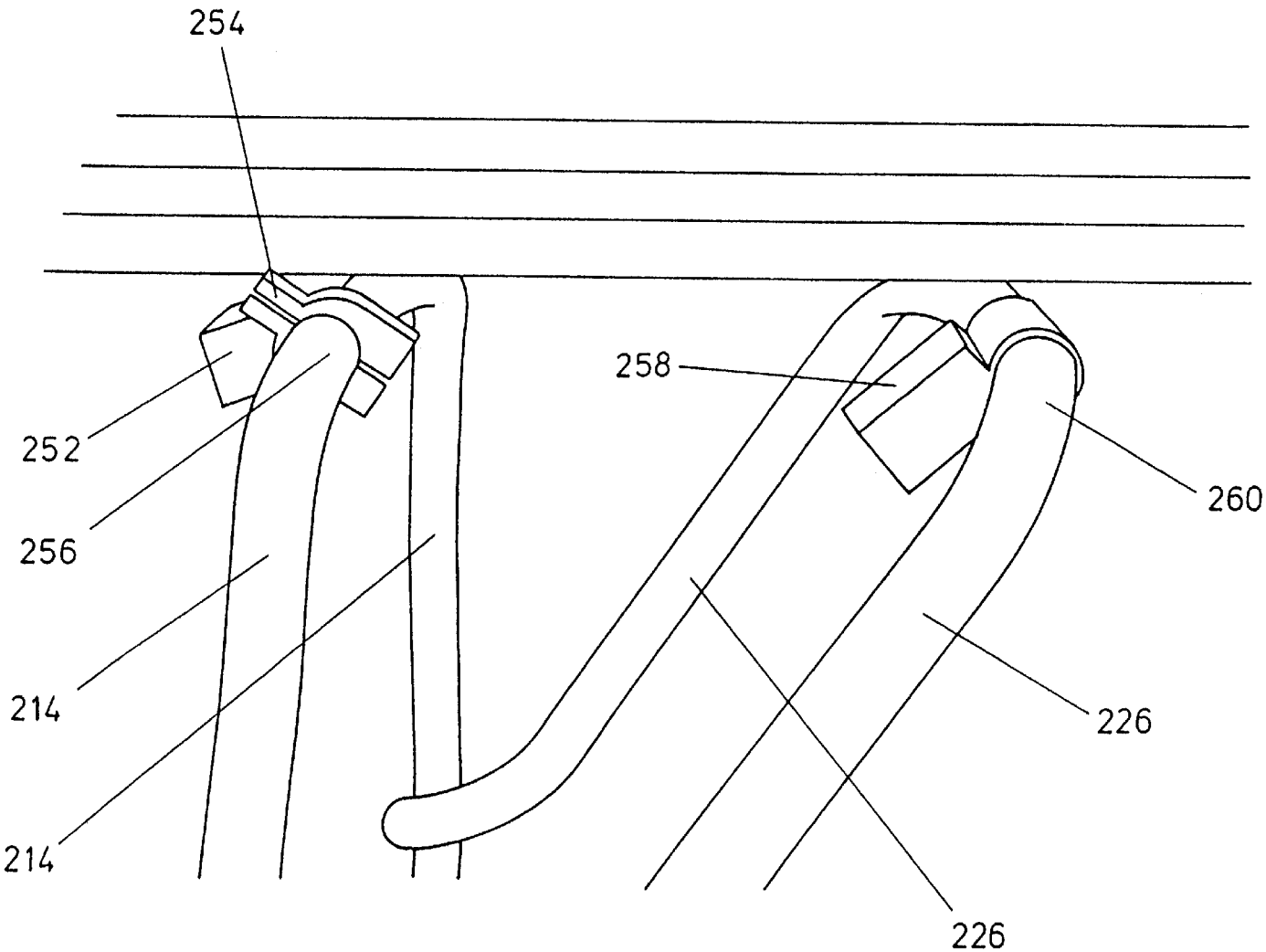
Figure 13:
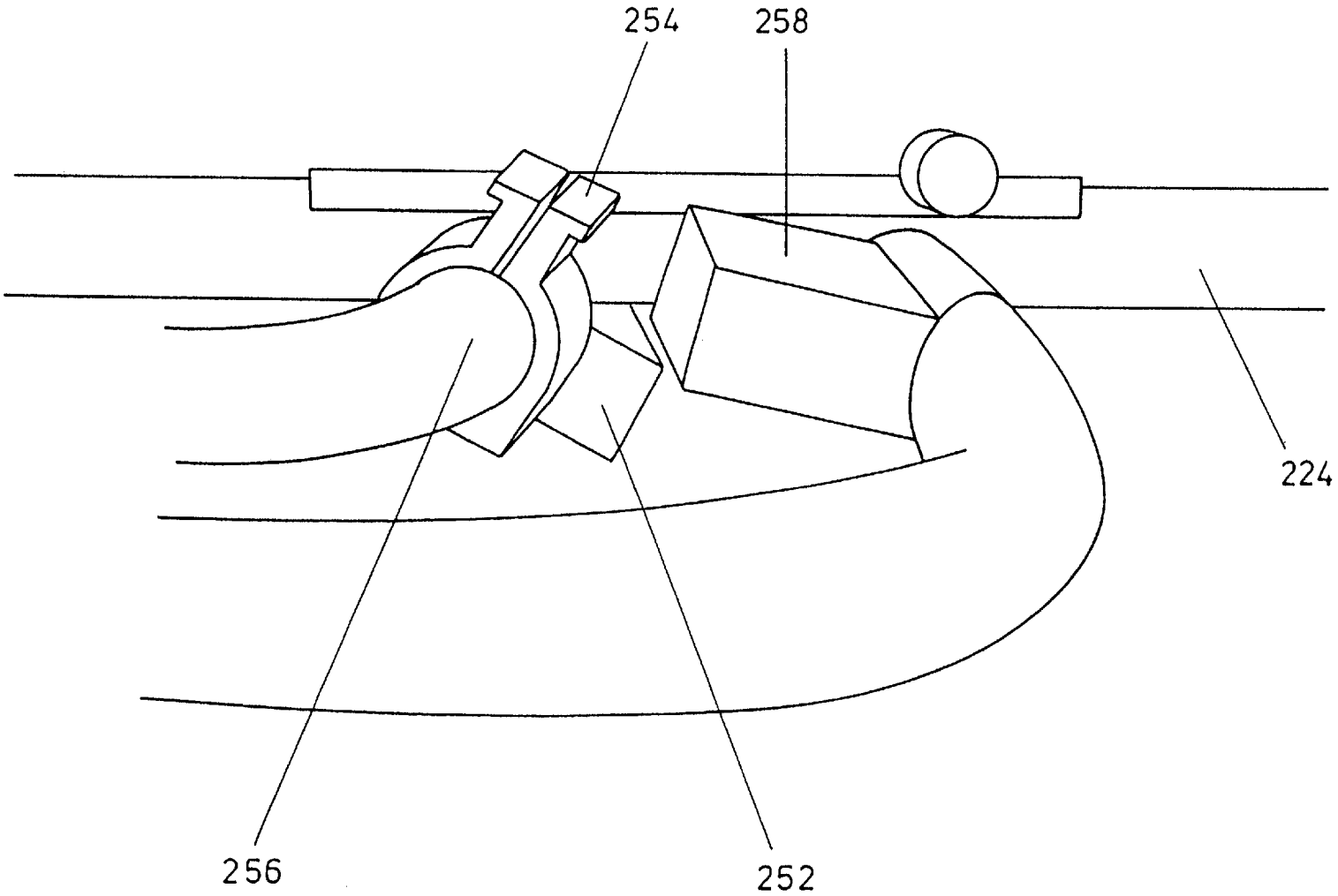

FIG. 3 is a perspective view of a stretcher trolley 110 according to a further embodiment of the present invention, and FIGS. 4 and 5 are side views of the trolley 110 in the raised position with the support being at an angle to the horizontal and horizontal respectively;

FIG. 6 is a side view of a further embodiment of a stretcher trolley;

FIG. 7 is a plan view of FIG. 6;

FIGS. 8, 9, 10 and 11 are side views showing the trolley of FIG. 6 in various different configurations, and FIGS. 12 and 13 are photographs showing the orientation of two parts of a counting device when the trolley of FIG. 6 is in the upper and collapsed positions.

Figure 1:
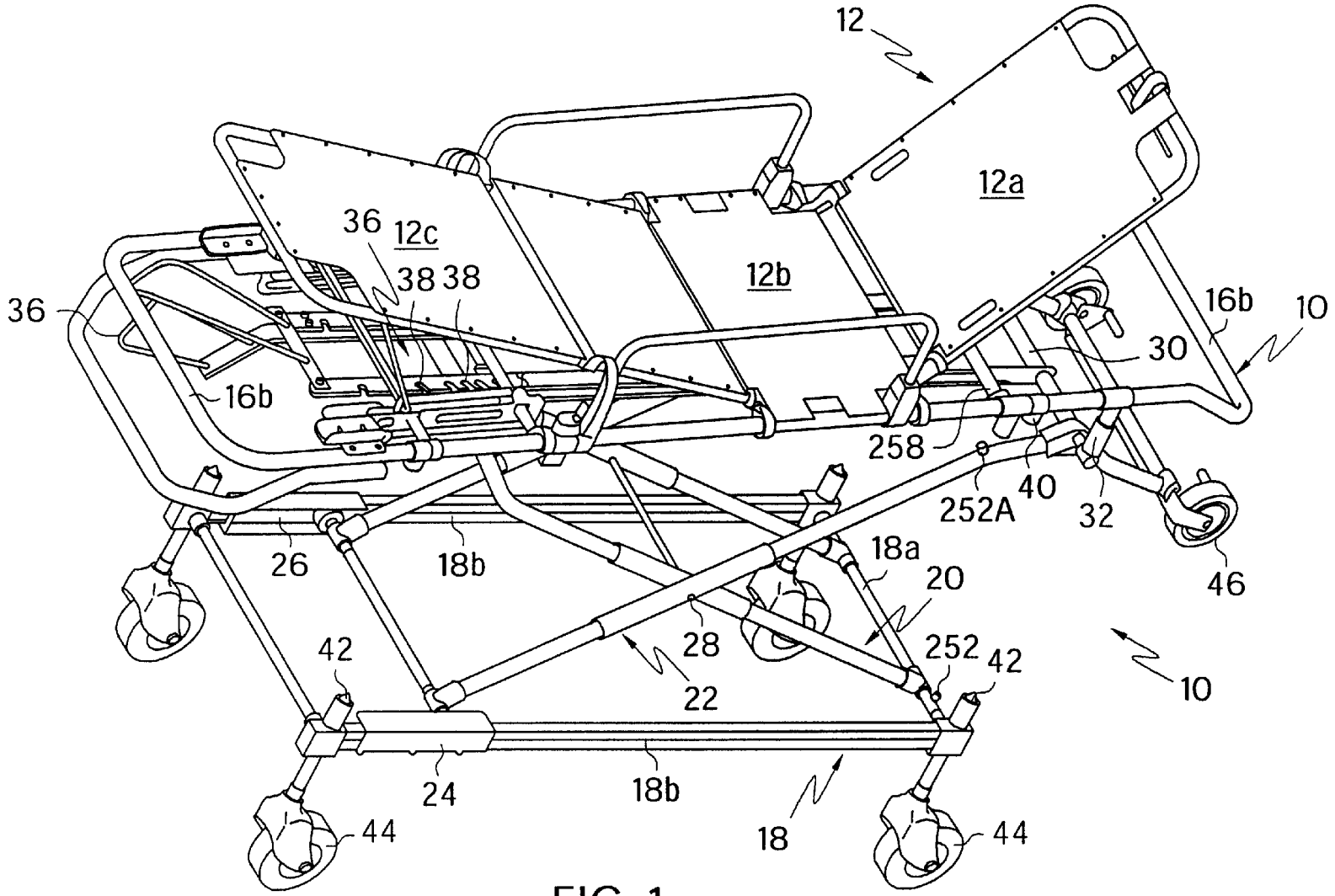
FIG. 1 is a perspective view of a first stretcher trolley 10 according to a first embodiment of the present invention with the trolley being in the raised position.
Figure 2:
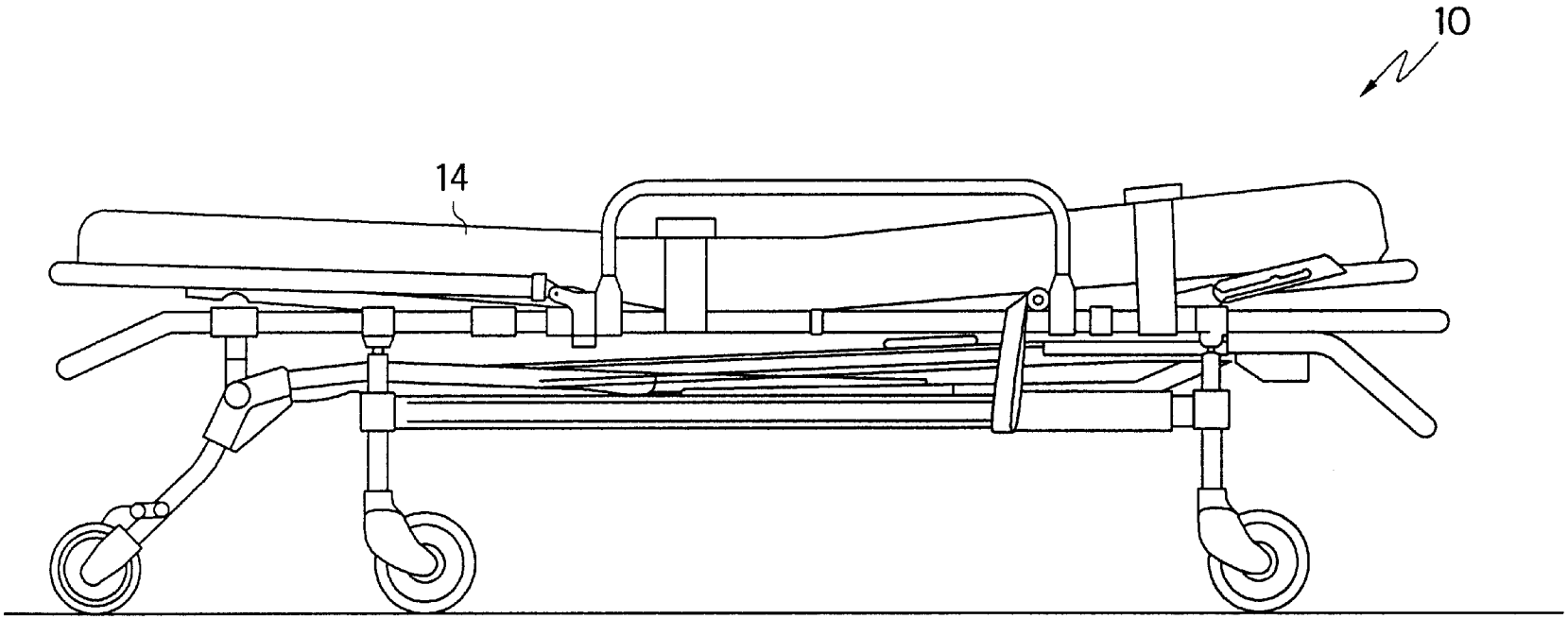
FIG. 2 is a side view of the trolley 10 in the lower position.

As shown in FIG. 1 the trolley 10 includes a support portion 12 defined by a back support portion 12*a*, a buttock support portion 12*b* and a leg support portion 12*c*. The angles of the back and leg support portions can be varied on the trolley by altering the angles of props that extend to beneath the support portion to the main frame of the trolley. The operation of such supports is well known and will not be described further. A mattress 14 can be located on the support portion 12, as shown in FIG. 2.

The trolley includes an upper quadrilateral frame 16 and a lower quadrilateral frame 18. The frames 16 and 18 are connected together by a first leg frame 20 that is pivotally connected to an end section 18*a* of the lower frame and a second leg frame 22. The leg frame 22 is connected to the side sections 18*b* of the lower frame via blocks 24 connected to the side sections 18*b*. The legs 22 are connected to the block 24 via rollers 26 that permit the legs 22 to move relative to the blocks 24 to a limited degree between the ends of the blocks in the direction of extent of the side sections 18*a*.

The leg frames 20 and 22 are connected together by a horizontal pivot rod 28.

The upper end of the leg frame 22 is pivotally connected, at each side, to a bar 30. Each end of the bar 30 is connected via a shaft 32 to the side of the upper frame 16.

The leg frame 22 is connected to the upper frame 16 by a sliding connection 34 in a well known manner such that, upon pulling of a handle 36 a lug restraining relative sliding movement is released from a slot 38 and the upper leg is able to slide towards or away from the end portion 16*b* of the upper frame. When the handle 36 is released the spring loaded lug returns into the next slot 38 that it comes into alignment with. This sliding movement of the upper end of the leg frame 20 causes the height of the stretcher to be raised or lowered. In the lowermost position sockets 40 are lowered on to spindles 42 of the upper frame and lower frame respectively, as shown in FIG. 2. In that position the upper frame rests on the lower frame and the leg frames are substantially parallel to each other.

In the raised position shown in FIG. 1 the trolley can be manoeuvred by being rolled along wheels 44 which can rotate about a horizontal axis and also about a vertical axis depending downwardly from each corner of the lower frame. In the raised position the trolley can approach an ambulance such that wheels 46, which can rotate about a horizontal axis and which are connected to the upper frame towards the front end 16*b* just below that end, rest on the floor of the ambulance. If desired the wheels 46 can be arranged to be at a slightly greater height than the floor of the ambulance. The rear of the trolley can then be lifted to pivot the trolley about the wheels 44 and to bring the wheels 46 into contact with the floor of the ambulance. The lower frame is then brought up to the upper frame and detachably retained in position. The trolley is then pushed into the ambulance. Removal of the trolley from the ambulance and the lifting of the upper frame relative to the lower frame is a reversal of the above described sequence.

In the lower position shown in FIG. 2 it is possible to manoeuvre the trolley with the wheels 44 providing the rolling motion required. The wheels 46 are just off the floor.

The embodiment described in FIGS. 3 to 5 will now be described. Like parts have been given the same numeral prefaced by the numeral 1.

As shown in FIG. 3, the trolley includes an upper rectangular frame 116 of round cross-section tube and a lower rectangular frame 118 also of round cross-section tube. Two pairs of leg frames 120 and 122 are provided with those frames each being connected to two different end sections 118*a*. A pivot rod 128 connects the two frames. Back 112*a*, buttock 112*b* and leg 112*c* supports are provided which are connected to the upper frame 116. The position of the back and leg supports can be pivotally adjusted in a well known manner.

A handle 136 at one end of the upper frame 116 can be pulled in the lengthwise direction of the trolley in order to move a locking bar (not shown) from a position in which it engages one pair of opposing slots to a position in which it is free of those slots. That rod is connected to the upper end of the frame 120. When the rod is clear of the slots the upper end of the frame 120 is free to slide towards or away from the end of the upper frame. This allows the trolley to be raised or lowered. When the handle 136 is released the bar, which is spring mounted, is resiliently biased back into engagement with the next pair of slots that it becomes aligned with. The trolley can be collapsed such that the leg frames 120 and 122 are substantially parallel with each other and with supports 40 on the upper frame resting on supports 142 at each corner of the lower frame.

Each corner of the lower frame includes wheels 144 that roll about a horizontal pivot with each wheel in turn being supported by a housing that can pivot about a vertical axis at each corner of the lower frame. The front end of the upper frame also includes a pair of spaced wheels 146 at each side that are located just beneath the extent of the upper frame. The stretcher 110 can be inserted into and removed from an ambulance as described in relation to the stretcher 10 and can also be moved on the wheels 144 when the stretcher is in the collapsed position as described in relation to the stretcher 10.

FIG. 4 shows the position that the stretcher can occupy, with the upper frame being inclined such that the front of the upper frame is higher than the lower end of the upper frame. That is achieved by pulling a lever (not shown) that allows the head and foot of the upper frame to be lowered by causing telescopic portions 148 of the leg frames 120 that extend between the pivot rod 128 and the lower end of the leg frame 120 to be extended. When the handle is released the telescopic portion is locked. When the handle is pulled again the head and foot portion can be pushed down to return the upper frame to the generally horizontal position.

The trolley 210 shown in FIGS. 6 to 13 will now be described.

A patient is arranged to be located on a mattress supported in the region of an upper quadrilateral frame 212. The frame has a forward leg frame 214 and a rearward leg frame 216 to the lower end of which wheels 218 and 220 are mounted. The wheels 218 are constrained to rotate in one direction but the wheels 210 are able to pivot about a vertical axis.

The leg frame 214 is pivotally connected to a block 222 that is able to slide on a rail 224 in the general direction of the elongate extent of the quadrilateral frame 212. The leg frame 214 is also, at a point intermediate of its upper and lower extent, pivotally connected to a strut frame 225 which, in turn, is mounted to the quadrilateral frame 212 at a pivot 228.

To load the trolley into an ambulance the trolley is rolled on the wheels 218 in the direction of arrow 230. A protective cover 232 on the strut 226 hits the back of the ambulance and, after one of a pair of levers 233 has been pulled to release the sliding block 222, the strut is swung to the left by the abutment with the ambulance about the pivot 228. At this time the front of the trolley is supported on the ambulance floor by a pair of wheels 236 that depend downwardly from the front of the quadrilateral frame 212. Whilst the strut 226 is moved to the left, the block 222 slides forwardly on the rail to raise the leg frame 214 upwardly and rearwardly about its pivot on the block until the protective cover 234 on the leg frame 214 abuts the ambulance. Continued movement of the frame into the ambulance causes the leg frame 214 and strut 226 to collapse and extend generally parallel to the quadrilateral frame 212.

When the leg frame 214 is moving to its collapsed position the spaced parallel legs of the frame 214 move to be either side of parallel struts 238 that are pivotally connected to the bottom of the leg frame 216 and the quadrilateral frame 212 by a pivot 240.

The rear leg frame 216 is slidably mounted on the rail by means of a block and the leg frame 216 is pivotally mounted on that block.

When the rear of the ambulance is abutted by a protective cover 242 in the struts 238, and when a lever 244 is pulled to release a lock retaining the block in which the leg frame is mounted, the struts 238 move upwardly and rearwardly about the pivot 240 and the leg frame 216 also moves upwardly and rearwardly with the upper part of the leg frame sliding forwardly via the block on the rail. A strut 246 is pivotally connected to the leg frame 216 at a location between the ends thereof and is pivotally mounted on the quadrilateral frame. Eventually the leg frame is substantially coextensive with the quadrilateral frame 212 as wheels 248 on the struts 238 support and guide the rear of the trolley on the floor of the ambulance.

Figure 8:
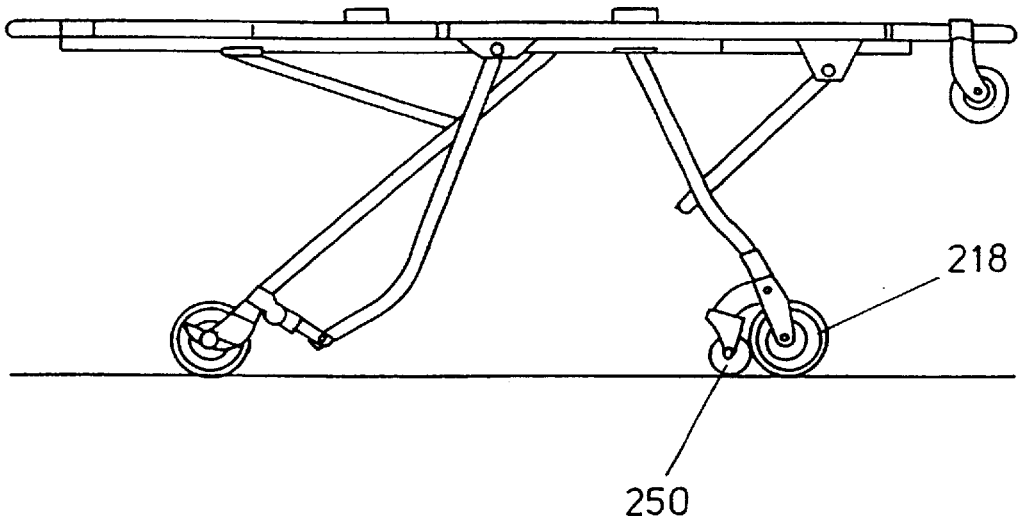
Figure 9:
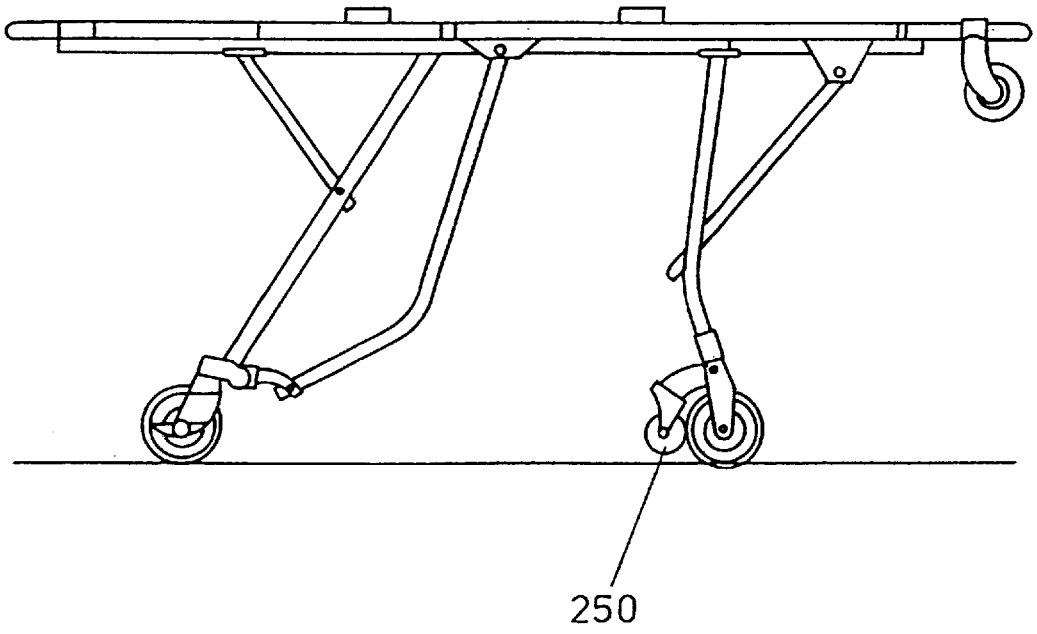

FIGS. 8 and 9 show how the blocks on the rail can be moved to and retained in different positions on the rail in order to achieve different operational positions for the trolley.

In FIG. 9 both leg frames 214 and 216 are in the fully extended position.

In FIG. 11 the legs have been pivoted slightly such that the quadrilateral frame remains horizontal but wheels 250 that can pivot about an axis perpendicular to their rolling axis engage with the ground. The wheels 250 are mounted at the bottom of the forward leg frame adjacent to the wheels 218.

In FIG. 9 the leg frame has been further collapsed such that the wheels 250 are just clear of the ground and, in FIG. 10, the collapse is further on and the wheels 250 are well clear of the ground.

Removal from an ambulance is a reversal of the insertion procedure except that the leg frames return under gravity when the relevant parts clear the rear of the vehicle.

Referring now to FIGS. 12 and 13, a magnet 252 is secured to a clamp 254 which is bolted on to a cross bar 256 that connects the upper end of the front leg frame 214. A counter 258 is bolted on to a cross bar 260 that connects the spaced struts 226.

In the position shown in FIG. 12, with the trolley in the upright position, the magnet and counter are spaced from each other. The counter 258 points downwardly and rearwardly and the magnet 252 points upwardly and forwardly.

When the frames of the trolley are moved towards each other, the cross bar 256 moves forwardly on the rail and rotates in a clockwise direction and the cross bar 260 rotates in an anticlockwise direction. Consequently the magnet moves forwardly and rotates with the bar 256 and the counter rotates with the bar 260 to cause the magnet to sweep past the counter thereby causing a count to be recorded. When the frames are raised the magnet sweeps past the counter and another count is recorded. If desired, the counter could be arranged to record every other count in order that the number recorded corresponds to the number of turns the stretcher is raised and lowered rather than recording each raising and lowering.

In a further embodiment, the magnet and counter could be mounted on different parts of a collapsible chair such that a count is recorded to record each collapsing of the chair. The chair may include a frame with the magnet and counter mounted on different parts of the frame. The magnet and counter may be as described or may move as described in relation to any of the stretcher embodiments.

In the first two embodiments, in order to record each time the upper frame is moved towards the lower frame a magnet 252 (or 252A in FIG. 1) is mounted on the lower frame and a reed switch 258 is mounted on the upper frame. Alternatively these parts could be mounted the other way round. The magnet does not come into contact with the reed switch but, in the lower position, the magnet would be within 10 mm of the reed switch. Each time the magnet comes within that proximity a counter is tripped and the counter moves on one. Accordingly, the counter will record the number of times that the frame has been raised and lowered or, alternatively or additionally the number of times that the trolley has been loaded or unloaded into an ambulance.

Either or both of the magnet and the reed switch in all embodiments can be concealed, it can be made weatherproof or can be made tamper-proof or both. In this way the counter is able to continue functioning and is not liable to be subjected to knocks that can push it out of line or detach it from the frame. Furthermore, the adverse whether conditions that the stretcher can be used in will not affect the operation of the counter and third parties are not able to access the counter.

In a further embodiment the counter may be located within a block which is mounted on either the lower or the upper frame in order to prevent tampering with the counter.

In a further embodiment the counter can be concealed in a tube of the frame. When the trolley is being serviced the tubes can be slid along in order to give access to the counter, the counter can be read and inspected and possibly have a battery replaced before the tube is moved back to conceal the counter again. If desired the tube can be secured in position with secure bolts.

A service engineer reading the counter can determine either that the trolley is ready for a service because it has completed, for the sake of argument, two hundred cycles of raising and lowering. Alternatively, a service engineer can determine that the stretcher is due for replacement if, for the sake of argument, the stretcher has been raised and lowered a thousand times.

Each trolley is assigned its own serial number and each counter may be given a corresponding serial number either directly on the counter or on the magnet or on a housing for the counter. In that way it will not be possible for counters to be switched from one trolley to another without a service engineer being aware of that switch.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed,may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A method of monitoring metal fatigue of a stretcher trolley including a support portion being movable between a first position and second position, the method comprising providing an indication of the number of times the support portion of the stretcher trolley is moved between said first and second positions.

2. A method as claimed in claim 1, further comprising periodically monitoring the number of times that the support portion has been moved between said first and second positions, and causing an event to occur as a result of the number of times that said support portion has been moved to at least one of the positions.

3. A patient handling apparatus, comprising:

a support portion being movable between a first position and second position; and a counter having a first and second parts arranged to move relative to each other such that at least one of said first and second parts moves when said support portion is translationally moved between said positions, said counter adapted to provide an indication of the number of times said support portion has been moved to at least one of said positions.

4. Apparatus as claimed in claim 3, in which relative movement of the first and second parts is arranged to effect the count.

5. Apparatus as claimed in claim 3, in which the first part comprises a magnet and the second part comprises a reed switch responsive to the magnet.

6. Apparatus as claimed in claim 3, in which the first and second parts are arranged to be spaced from each other when the support portion is being moved between the first and second positions and when the support portion is in the first and second positions.

7. Apparatus as claimed in claim 3 in which the first and second parts are both arranged to move.

8. Apparatus as claimed in claim 3, in which at least one part of said counter is arranged to be located beneath the support portion.

9. Apparatus as claimed in claim 3, in which said counter is arranged to record every alternative count.

10. Apparatus as claimed in claim 3, in which at least part of said counter is concealed.

11. Apparatus as claimed in claim 3, in which at least part of said counter is located in part of a frame of the patient handling apparatus.

12. A patient handling apparatus, comprising:

a support portion being movable between a first position and second position; and a counter having a first and second parts arranged to move relative to each other such that at least one of said first and second parts moves when said support portion is pivotally moved between said positions, said counter adapted to provide an indication of the number of times said support portion has been moved to at least one of said positions.

13. Apparatus as claimed in claim 12 in which relative movement of the first and second parts is arranged to effect the count.

14. Apparatus as claimed in claim 12 in which the first part comprises a magnet and the second part comprises a reed switch responsive to the magnet.

15. Apparatus as claimed in claim 12 in which the first and second parts are arranged to be spaced from each other when the support portion is being moved between the first and second positions and when the support portion is in the first and second positions.

16. Apparatus as claimed in claim 12 in which the first and second parts are both arranged to move.

17. Apparatus as claimed in claim 12 in which at least one part of said counter is arranged to be located beneath the support portion.

18. Apparatus as claimed in claim 12 in which said counter is arranged to record every alternative count.

19. Apparatus as claimed in claim 12 in which at least part of said counter is concealed.

20. Apparatus as claimed in claim 12 in which at least part of said counter is located in part of a frame of the patient handling apparatus.

21. A stretcher trolley, comprising:

a first frame;

a second frame;

leg frames operatively connected between said first and second frames, and arranged to move said second frame relative to said first frame at least between a first position and a second position; and a counter mounted to said stretcher trolley and adapted to provide an indication of the number of times said second frame is moved to at least one of said positions.

* * * * *